US005347096A

United States Patent [19]

Bolongeat-Mobleu et al.

[11] Patent Number: 5,347,096

[45] Date of Patent: Sep. 13, 1994

[54] ELECTRICAL CIRCUIT BREAKER WITH TWO VACUUM CARTRIDGES IN SERIES

[75] Inventors: Roger Bolongeat-Mobleu, Echirolles; Fredéric Burnaz, Sassenage; Peter Malkin, St. Nazaire les Eymes, all of France

[73] Assignee: Merlin Gerin, France

[21] Appl. No.: 962,516

[22] Filed: Oct. 15, 1992

[30] Foreign Application Priority Data

Oct. 17, 1991 [FR] France ..... 91 13062

[51] Int. Cl.[5] ..... H01H 33/66

[52] U.S. Cl. ..... 200/148 B; 200/144 B; 200/146 R

[58] Field of Search ..... 200/144 B, 145, 146 R, 200/148 B

[56] References Cited

U.S. PATENT DOCUMENTS 3,671,696 6/1972 Brunner ..... 200/144 B
4,550,234 10/1985 Steinemer ..... 200/144 B
4,814,559 3/1989 Stegmuller ..... 200/145
5,155,315 10/1992 Malkin et al. ..... 200/148 R
5,239,150 8/1993 Bolongeat-Mobleu et al. .... 200/148 R

FOREIGN PATENT DOCUMENTS 2611310 8/1988 France ..... H01H 33/02

*Primary Examiner*—J. R. Scott
*Attorney, Agent, or Firm*—Parkhurst, Wendel & Rossi

[57] ABSTRACT

Inside a sealed enclosure (10) filled with sulphur hexafluoride there are housed main contacts (17,19) and an auxiliary circuit comprising two vacuum cartridges (20,21) electrically connected in series with each other and in parallel with the main contacts. The vacuum cartridges (20,21) are operated by a single mechanism to open and close simultaneously and serial connection enables the voltage withstand to be increased. The invention can be applied to medium or high voltage gas-insulated installations or substations.

12 Claims, 2 Drawing Sheets

ELECTRICAL CIRCUIT BREAKER WITH TWO VACUUM CARTRIDGES IN SERIES

BACKGROUND OF THE INVENTION

The invention relates to a medium or high voltage electrical circuit breaker having per pole a support for two vacuum cartridges each of which contains a pair of separable contacts. The pairs of separable contacts are electrically connected to each other in series by an electrical connection to increase the voltage withstand of the pole and, each pair comprising a movable contact which is connected by a mechanical connection to open and close the two pairs of contacts simultaneously.

A state-of-the-art circuit breaker of the kind mentioned, comprises two vacuum cartridges, arranged one above the other, inside an elongated support, borne by an insulating console secured to a frame. It is known that the dielectric withstand of vacuum cartridges is limited and that it is extremely difficult to exceed surge voltages of 100 to 250 KV. By connecting two or more cartridges in series, it is possible to increase this dielectric withstand notably and to achieve medium or high voltage circuit breakers. The above-mentioned state-of-the-art circuit breaker is very voluminous and cumbersome, and requires a large operating energy, practically twice that of a single cartridge. Incorporating such a circuit breaker in a cubicle gives rise to serious problems to which should be added the risks of overheating which are also doubled.

The object of the present invention is to achieve an electrical vacuum cartridge circuit breaker having a notably increased dielectric withstand.

SUMMARY OF THE INVENTION

The circuit breaker according to the invention is characterized in that the two cartridges are rigidly secured inside a sealed enclosure which is filled with a high dielectric strength gas. The enclosure contains an electrical connection between the pairs of contacts and a mechanical connection between the movable contacts. Each vacuum cartridge comprises an insulating housing whose creepage distance corresponds to the dielectric withstand of the housing in the high dielectric strength gas, and a pair of main contacts is arranged in the enclosure to be electrically connected in parallel with the pairs of contacts arranged as arcing contacts of the two serially mounted vacuum cartridges. The circuit breaker is operated by the operating mechanism to open before the arcing contacts and to close after the arcing contacts.

By arranging the vacuum cartridges in the manner described in U.S. Pat. No. 4,155,315, in an enclosure filled with sulphur hexafluoride, the external dimensions of the cartridges, and thereby those of the enclosure, can be appreciably reduced. Connection of the two vacuum cartridges in parallel to the main contacts, also housed inside the enclosure, allows flow of the permanent current via the main contacts, thereby preventing any overheating of the vacuum cartridges whose contacts can be made of a high resistivity material, notably a refractory material which resists the action of the arc. The vacuum cartridge contacts which constitute the arcing contacts of the circuit breaker do not have current flowing through them under normal operation, and their operating energy can be reduced by the use of a precompressed contact pressure spring, in the manner described in detail in copendng U.S. patent application Ser. No. 07/889,408 filed Jun. 3, 1991, now U.S. Pat. No. 5,239,150 which should be advantageously referred to for further details. All these advantages of vacuum cartridges arranged in sulphur hexafluoride, i.e. their small size, their low operating energy and their low heat dissipation, facilitate the housing in a single enclosure of two or more vacuum cartridges operated by a con, non mechanism. High voltage circuit breakers can thus be achieved combining the advantages of sulphur hexafluoride insulation and those of vacuum breaking.

The vacuum cartridge advantageously comprises a coil generating an axial magnetic field in the arc formation zone, and the arcing contacts are made of a high resistivity material, for example a refractory material or equivalent. The main contacts are advantageously aligned, in the closed position, with two bushings arranged on opposite sides of the enclosure, so as to reduce the trajectory of the rated current flow. The vacuum cartridges are juxtaposed to this straight current trajectory, in order to facilitate, by reduction of the loop effect, switching of the current to the shunt circuit, formed by the vacuum cartridges. The movable main contact can be a pivoting or rotary knife-blade contact providing either single breaking or double breaking. The arrangement of the vacuum cartridges inside the enclosure is determined by the general architecture of the circuit breaker and naturally depends on the number of cartridges to be incorporated in the enclosure.

In a preferred embodiment, two cartridges are arranged in parallel with their movable contacts located on the same side and connected by an operating bar. Another advantageous arrangement is an aligned arrangement of the two vacuum cartridges arranged one following the other. In the latter case, the two movable contacts of the vacuum cartridges are facing one another and are connected by a toggle system, ensuring simultaneous operation of the two movable contacts.

The operating mechanism performs in the usual manner prior opening of the main contacts and inversely, closing of the main contacts after that of vacuum cartridge contacts acting as arcing contacts. The operating mechanism comprises a rotary shaft passing through the wall of the enclosure and supporting inside this enclosure an operating crank. This operating crank can be double or be achieved by two cranks, each secured to the operating shaft, one of the cranks being connected by a connecting rod to the movable arcing contact, whereas the other is connected to the movable main contact. It is also possible to achieve movement of the movable contacts by mechanically interconnecting the arcing contacts and the main contact and transmitting the operating movement of the rotary shaft directly to one of these contacts, notably to the movable main contact. Other operating modes are naturally conceivable.

The circuit breaker according to the invention is particularly suited to a medium voltage gas-insulated installation, the enclosure then comprising an grounded metal envelope. The same enclosure can contain the three circuit breaker poles, which enables an additional reduction of the overall dimensions to be achieved.

BRIEF DESCRIPTION OF THE DRAWINGS

Other advantages and features will become more clearly apparent from the following description of two illustrative embodiments of the invention, given as nonrestrictive examples only and represented in the accompanying drawings in which.

DESCRIPTION OF THE PREFERRED EMBODIMENT

Figure 1:
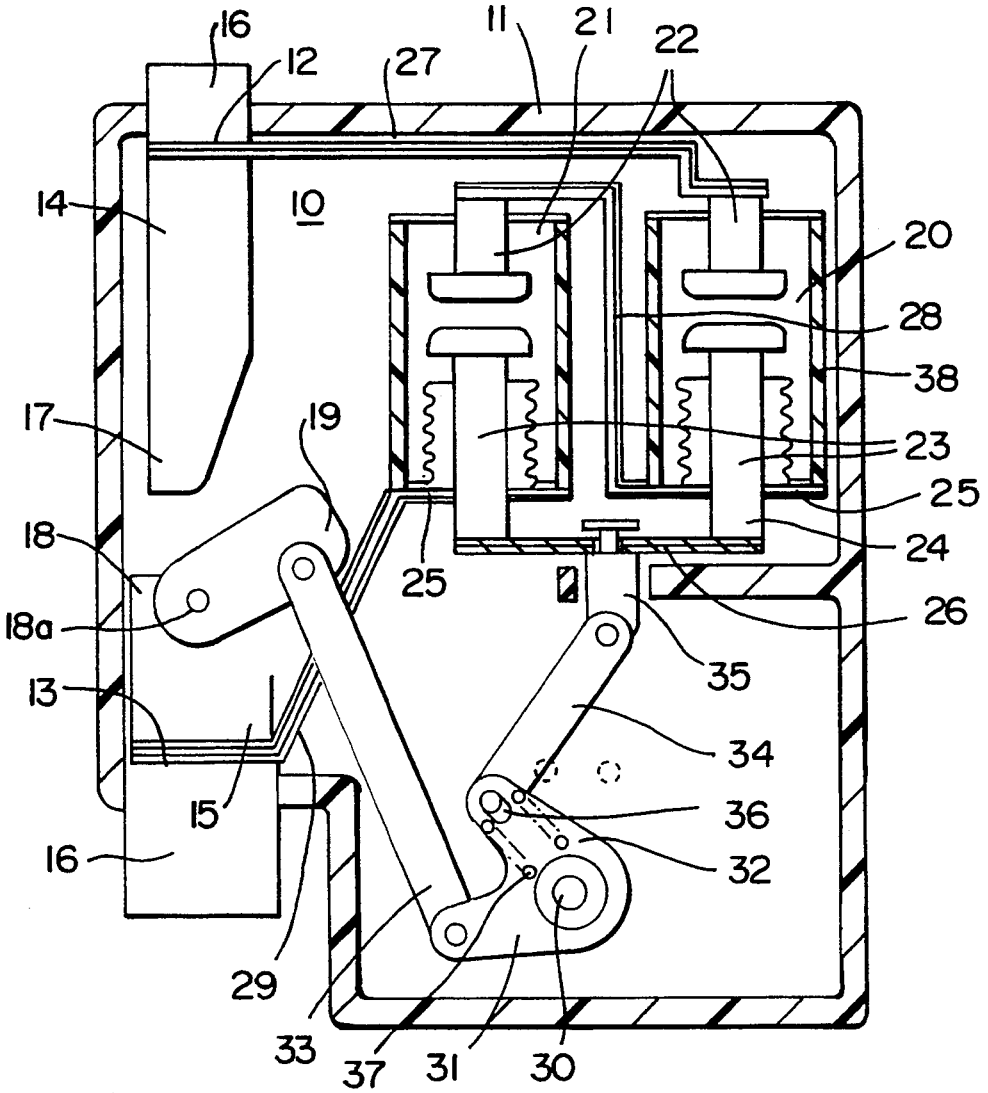
FIG. 1 is a schematic elevational view of a circuit breaker according to the invention, with the wall being assumed to have been removed.

In the drawings, a medium voltage or high voltage circuit breaker is housed in a sealed enclosure 10, whose metal or insulating wall 11 can be that of a gas-insulated installation or substation, or that of a pole or of the three poles of the circuit breaker. The pole represented in FIG. 1 comprises two tight bushings 12,13, two current input and output conductors 14 and 15 which are terminated outside the enclosure 10 by connection terminals 16 and inside respectively by a stationary main contact 17 and by a support 18 of a movable main contact 19 in the form of a knife-blade pivotally mounted on a fixed axis 18*a*. In the closed position of the circuit breaker, the movable main contact 19 is aligned with the bushings 12,13 and cooperates with the stationary main contact 17 to close the main circuit connecting the input and output terminals 16. The enclosure 10 is filled with a high dielectric strength gas, notably sulphur hexafluoride, at atmospheric pressure or higher.

The enclosure 10 contains two vacuum cartridges 20,21, of general cylindrical shape, whose longitudinal axes are parallel to one another and parallel to the alignment direction of the bushings 12,13. The two vacuum cartridges 20,21 are arranged next to one another at the same level, and next to the main contacts 17,19. The two vacuum cartridges 20,21 are identical and both comprise a stationary contact 22 which cooperates with a slidingly mounted movable contact 23, extended by an operating rod 24, passing tightly through one of the end-plates 25 of the vacuum cartridges 20,21. The operating rods 24 of the movable contacts 23 of the vacuum cartridges 20,21, which constitute arcing contacts, are both located on the same side, and are secured by a transverse bar 26. The two vacuum cartridges 20,21 are electrically connected in series in an auxiliary arcing circuit formed by a conductor 27 connecting the bushing 12 to the stationary arcing contact 22 of the vacuum cartridge 20, by a bent conductor 28 connecting the movable arcing contact 23 of the vacuum cartridge 20, via the metal end-plate 25, to the stationary arcing contact 22 of the cartridge 21, and by a conductor 29 connecting the movable arcing contact 23 of the cartridge 21, via the metal end-plate 25 to the bushing 13. It can easily be seen that this auxiliary circuit formed by the conductor 27, vacuum cartridge 20, conductor 28, cartridge 21 and conductor 29 is connected in parallel to the main contacts 17,19.

A rotating operating shaft 30 passes through the wall 11 of the enclosure, and bears at its inside end a crank with two arms 31,32. One arm 31 is connected by a connecting rod 33 to the pivoting main contact 19, and the other arm 32 is connected by a connecting rod 34 to a sliding block 35 secured to the transverse bar 26. The connection between the arm 32 and the connecting rod 34 comprises a buttonhole 36, which constitutes a dead travel link, biased in extension by a precompressed spring 37. The mechanism is arranged in such a way that in the course of a circuit breaker opening operation, brought about by a counterclockwise rotation of the shaft 30, the arcing contacts 23 initially remain closed, due to the dead travel link 36. The current which was flowing via the main contacts 17,19 is switched to the arcing circuit without an arc forming on the main contacts 17,19. Continued rotation of the shaft 30 brings about opening of the arcing contacts 23 and of the circuit breaker. The reverse closing operation, brought about by a clockwise rotation of the operating shaft 30, first closes the arcing contacts 23 and then closes the main contacts 17,19, in a manner well-known to those specialized in the art. The precompressed spring 37 only acts on a very limited travel between closing of the arcing contacts 22,23 and closing of the main contacts 17,19, which enables the operating energy to be notably reduced, in the manner described in the copending U.S. patent application Ser. No. 07/889,408, filed Jun. 3, 1991, now U.S. Pat. No. 5,239,150, which should advantageously be referred to for further details on the operation of the operating mechanism.

The cylindrical enclosure 38 of the vacuum cartridges 20,21 is made of ceramic material or glass with a smooth internal surface, whose axial length defines the critical creepage distance of the vacuum cartridges 20,21. This axial length is determined in terms of the voltage, to ensure a sufficient dielectric withstand, and this length is notably less than that of a cartridge placed in air. Connecting the two cartridges 20,21 in series increases notably and practically doubles the voltage withstand of the circuit breaker.

The permanent current flows through the elements 14,17,19, 13, and the arcing contact 22,23 can be made of a high resistivity material, as the current only flows through them during the short switching time of the current to the auxiliary circuit. An axial magnetic field is generated by the trajectory of the current in the arcing contacts 22,23, or by a coil (not shown) for arc diffusion, and the high resistivity of the contact parts contributes to reducing the currents induced in these contacts by the magnetic field.

It can easily be seen that a larger number of vacuum cartridges 20,21 can be housed in the enclosure 10, and that the invention is not limited to a particular arrangement of these cartridges, or to a particular structure thereof. The operating mechanism and structure of the main contacts can also be modified, as described with reference to FIG. 2.

Figure 2:
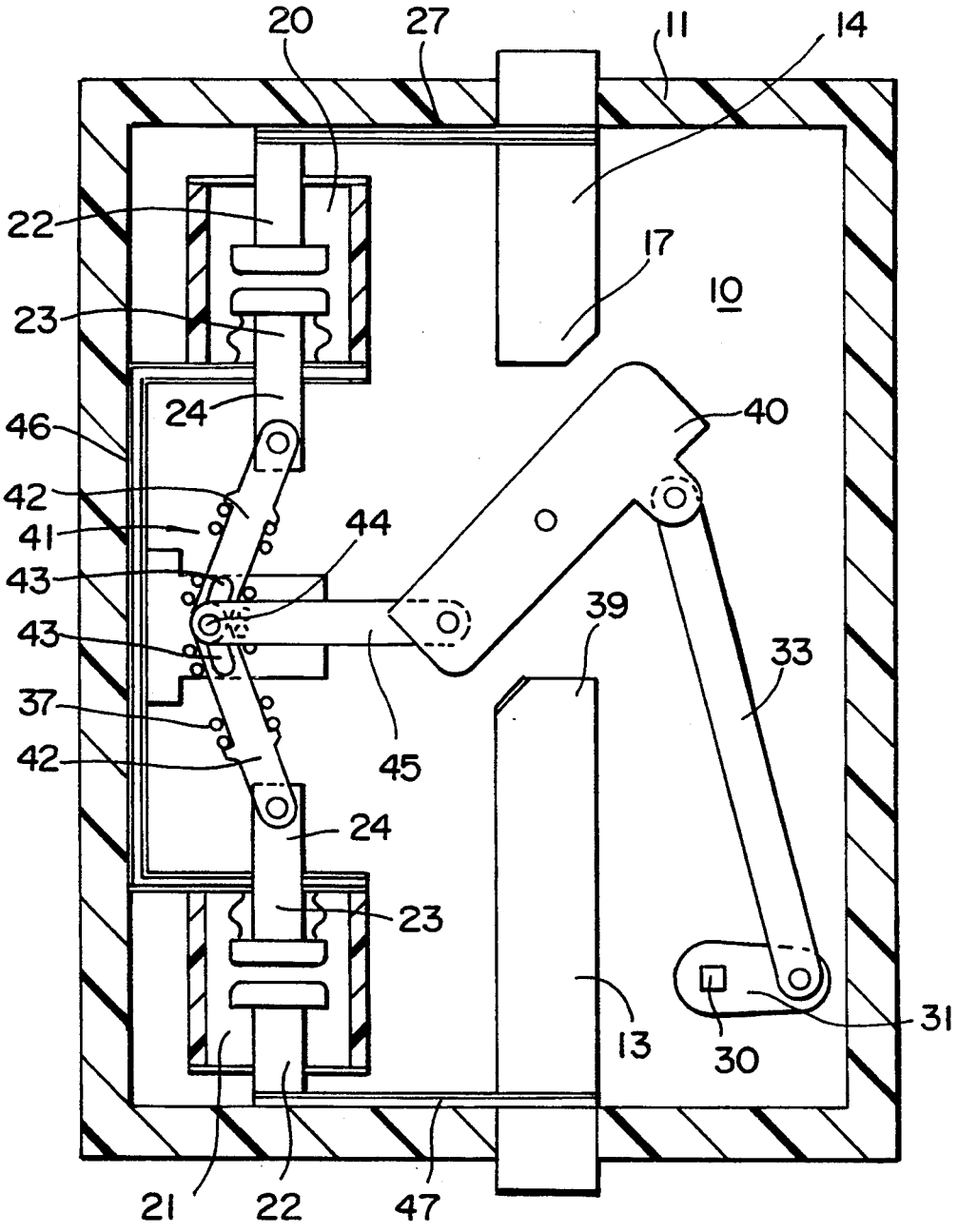
FIG. 2 is a similar view to that of FIG. 1, showing an alternative embodiment of the circuit breaker.

In FIG. 2, the same reference numbers are used to designate similar or identical parts to those of FIG. 1. The aligned bushings 13,14 can be recognized, both bearing at one end a stationary main contact 17,39, cooperating with a movable main contact 40 in the form of a rotary contact bridge, coming in the closed position into contact with the stationary contacts 17,39, to constitute an aligned main circuit 14,40,13. The vacuum cartridges 20,21 are arranged on the same parallel axis and adjacent to the main circuit 14,40,39. The cartridges 20,21 are spaced apart and their movable contacts 23 face one another cooperating with a toggle mechanism 41 inserted between the two movable arcing contacts 23. Each contact rod 24 has articulated on it a connecting rod 42 terminated at the opposite end by a buttonhole 43. The two buttonholes 43 are superposed and have passing through them a spindle 44 supported by a connecting rod 45, articulated on the movable main contact 40. A precompressed spring 37 biases the spindle 44 towards the bottom of the buttonholes 43. With the circuit breaker in the open position, represented in FIG. 2, it can be understood that a counterclockwise rotation of the operating shaft 30 brings about rotation of the movable main contact 40 to the closed position, which rotation is transferred by the rod 45 into a sliding movement of the spindle 44 to the right. This translation of the spindle 44 causes an extension of the toggles formed by the connecting rods 42 and contact rods 24, and closing of the arcing contacts 22, 23. The precompressed springs 37 only operate at the end of closing travel of the arcing contacts 22, 23 and it is clear that the latter close simultaneously, the assembly being arranged so that they close before the main contacts 17,40,39, in a manner well-known to those specialized in the art.

An electrical conductor 27 connects the bushing 14 to the stationary arcing contact 22 of the vacuum cartridge 20, whereas the two movable arcing contacts 23 are electrically connected by a conductor 46, and the stationary arcing contact 22 of the cartridge 21 is connected by a conductor 47 to the bushing 13. It can be seen that the auxiliary circuit 27,20,46,21,47 shunts the main contacts 17,40,39 and that the cartridges 20,21 are connected in series in this auxiliary circuit. Operation is naturally identical to that described above, with reference to FIG. 1, the use of a movable main contact 40 with double breaking improving the voltage withstand for a smaller opening travel.

The cartridges 20,21 are fixed to the wall 11 by any suitable means, notably by insulating supports (not represented) or notably by the connecting conductors 27,29; 27,46,47 arranged as supports secured to the wall 11.

The invention is naturally in no way limited to the embodiments more particularly described herein.

We claim:

1. A medium to high voltage circuit breaker comprising:

first and second vacuum switches, said first vacuum switch comprising a first pair of arcing contacts housed in a first insulating housing and including a first movable arcing contact, said second vacuum switch comprising a second pair of arcing contacts housed in a second insulating housing and including a second movable arcing contact;

an electrical connector connecting the first and second vacuum switches to each other in series;

a mechanical link connected to said first and second movable arcing contacts to open and close the first and second pairs of arcing contacts simultaneously;

a pair of main contacts electrically connected in parallel to said first and second arcing contacts;

an operating mechanism connected to said main contacts and to said mechanical link to open the first and second pairs of arcing contacts after the pair of main contacts open and to close the first and second pairs of arcing contacts before the pair of main contacts close; and a sealed enclosure filled with a high dielectric strength gas and housing therein said first and second vacuum switches, said electrical connector, said mechanical link, said pair of main contacts and said operating mechanism.

2. The circuit breaker of claim 1, wherein the first vacuum switch comprises first means for producing an axial magnetic field in an arc formation zone formed upon separation of the first pair of arcing contacts, and wherein the second vacuum switch comprises second means for producing an axial magnetic field in an arc formation zone formed upon separation of the second arcing contacts.

3. The circuit breaker of claim 1, wherein the arcing contacts comprise a high resistivity material.

4. The circuit breaker of claim 3, wherein the high resistivity material is a refractory material.

5. The circuit breaker of claim 1, wherein the enclosure comprises input and output connectors respectively connected to said first and second main contacts, wherein the input and output conductors and said main contacts are substantially colinear when said main contacts are closed.

6. The circuit breaker of claim 5 wherein the first and second vacuum switches are arranged side by side, and wherein said mechanical link comprises a bar connected to the first and second movable arcing contacts and to said operating mechanism.

7. The electrical circuit breaker of claim 5, wherein the first and second vacuum switches are colinear such that the first and second movable arcing contacts face each other, the mechanical link being disposed between the first and second movable arcing contacts and comprising a toggle.

8. The circuit breaker of claim 6, wherein the operating mechanism comprises a rotary operating shaft which gas-tightly passes into said enclosure, first and second cranks supported on the operating shaft, a first rod interconnecting the first crank to the bar of the mechanical link, and a second rod interconnecting one of the main contacts and the second crank.

9. The circuit breaker of claim 7, wherein the operating mechanism comprises a rotary operating shaft passing gas-tightly into said enclosure, and a crank supported on the rotary shaft and connected to one of the main contacts and to a rod, said rod interconnecting said toggle and said crank.

10. The circuit breaker of claim 1, wherein an axial length of each of said first and second insulating housings corresponds to a dielectric withstand of said first and second vacuum switches in said high dielectric strength gas.

11. The circuit breaker of claim 1, wherein said mechanical link comprises first and second compressible linkages respectively coupled to said first and second arcing contacts.

12. The circuit breaker of claim 1, wherein said operating mechanism comprises a single compressible linkage coupled to said mechanical link.

* * * * *